US009483019B2

(12) United States Patent
Nakai et al.

(10) Patent No.: US 9,483,019 B2
(45) Date of Patent: Nov. 1, 2016

(54) IMAGE FORMING APPARATUS AND IMAGE FORMING METHOD

(71) Applicant: FUJI XEROX CO., LTD., Tokyo (JP)

(72) Inventors: Daisuke Nakai, Kanagawa (JP); Hisashi Murase, Kanagawa (JP); Atsumi Kurita, Kanagawa (JP); Masakazu Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/857,326

(22) Filed: Sep. 17, 2015

(65) Prior Publication Data

US 2016/0282805 A1 Sep. 29, 2016

(30) Foreign Application Priority Data

Mar. 25, 2015 (JP) ..... 2015-063024

(51) Int. Cl.
*G03G 15/20* (2006.01)
*G03G 21/20* (2006.01)

(52) U.S. Cl.
CPC ..... *G03G 21/206* (2013.01)

(58) Field of Classification Search
CPC ..... G03G 15/2021; G03G 15/205; G03G 15/6585; G03G 2215/00805; G03G 2215/2032; G03G 15/0131; G03G 15/161; G03G 15/2017; G03G 15/2039; G03G 15/2064; G03G 15/24; G03G 21/206; G03G 2215/00455
See application file for complete search history.

(56) References Cited

U.S. PATENT DOCUMENTS

2012/0107004 A1* 5/2012 Sonohara ..... G03G 15/6585 399/69
2012/0321362 A1* 12/2012 Hirota ..... G03G 15/657 399/341

FOREIGN PATENT DOCUMENTS

JP 2004-258537 A 9/2004

* cited by examiner

*Primary Examiner* — Roy Y Yi
(74) *Attorney, Agent, or Firm* — Sughrue Mion, PLLC

(57) ABSTRACT

An image forming apparatus includes a transport unit that transports a recording medium; a forming unit that forms a toner image on the recording medium, the toner image including a resin and a flat metallic pigment; a fixing unit that fixes the toner image to the recording medium by heating and pressing the toner image; and a cooling unit that cools the toner image fixed by the fixing unit, the cooling unit being disposed at a position at which the cooling is started when a temperature of the toner image is higher than or equal to a glass transition temperature.

15 Claims, 7 Drawing Sheets

FIG. 5A
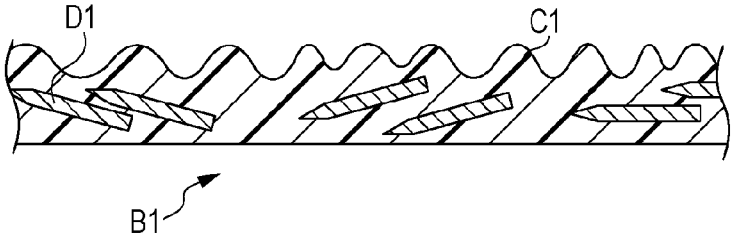
FIG. 5B
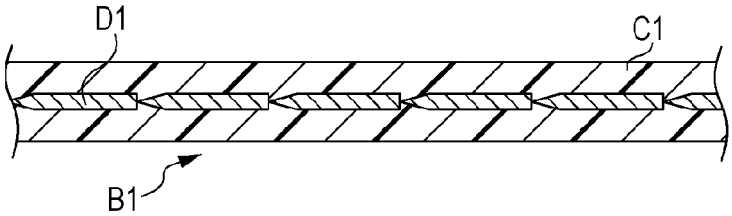
FIG. 5C
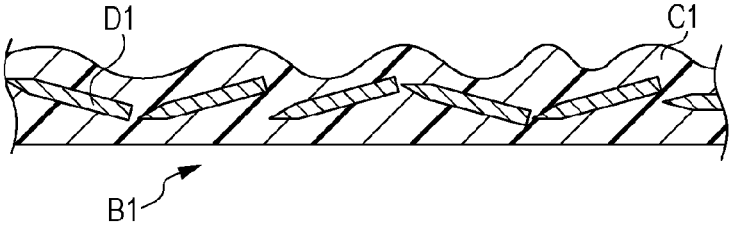
FIG. 6
| RANGE OF TRANSPORT SPEED | COOLING STRENGTH |
|---|---|
| LOWER THAN G1 | LOW |
| G1 OR HIGHER AND LOWER THAN G2 | INTERMEDIATE |
| G2 OR HIGHER | HIGH |

| RANGE OF FIXING TEMPERATURE | COOLING STRENGTH |
|---|---|
| LOWER THAN H1 | LOW |
| H1 OR HIGHER AND LOWER THAN H2 | INTERMEDIATE |
| H2 OR HIGHER | HIGH |

| TYPE OF RECORDING MEDIUM | COOLING STRENGTH |
|---|---|
| NORMAL SHEET | HIGH |
| THICK SHEET | LOW |

| RANGE OF PRESSURE | COOLING STRENGTH |
|---|---|
| LOWER THAN J1 | HIGH |
| J1 OR HIGHER AND LOWER THAN J2 | INTERMEDIATE |
| J2 OR HIGHER | LOW |

| RANGE OF NIP WIDTH | COOLING STRENGTH |
|---|---|
| SMALLER THAN K1 | LOW |
| H1 OR LARGER AND SMALLER THAN H2 | INTERMEDIATE |
| K2 OR LARGER | HIGH |

| RANGE OF TONER AMOUNT | COOLING STRENGTH |
|---|---|
| SMALLER THAN L1 | LOW |
| L1 OR LARGER AND SMALLER THAN L2 | INTERMEDIATE |
| L2 OR LARGER | HIGH |

| RANGE OF TONER IMAGE TEMPERATURE | COOLING STRENGTH |
|---|---|
| LOWER THAN M1 | LOW |
| M1 OR HIGHER AND LOWER THAN M2 | INTERMEDIATE |
| M2 OR HIGHER | HIGH |

| RANGE OF AMBIENT TEMPERATURE | COOLING STRENGTH |
|---|---|
| LOWER THAN N1 | HIGH |
| N1 OR HIGHER AND LOWER THAN N2 | INTERMEDIATE |
| N2 OR HIGHER | LOW |

| RANGE OF HUMIDITY | COOLING STRENGTH |
|---|---|
| LOWER THAN P1 | LOW |
| P1 OR HIGHER AND LOWER THAN P2 | INTERMEDIATE |
| P2 OR HIGHER | HIGH |

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2015-063024 filed Mar. 25, 2015.

BACKGROUND

Technical Field

The present invention relates to an image forming apparatus and an image forming method.

SUMMARY

According to an aspect of the present invention, an image forming apparatus includes a transport unit that transports a recording medium; a forming unit that forms a toner image on the recording medium, the toner image including a resin and a flat metallic pigment; a fixing unit that fixes the toner image to the recording medium by heating and pressing the toner image; and a cooling unit that cools the toner image fixed by the fixing unit, the cooling unit being disposed at a position at which the cooling is started when a temperature of the toner image is higher than or equal to a glass transition temperature.

BRIEF DESCRIPTION OF THE DRAWINGS

Exemplary embodiments of the present invention will be described in detail based on the following figures, wherein:

FIGS. 5A to 5C illustrate states of metallic pigment particles in a toner image;

FIG. 6 illustrates an example of a control table;

DETAILED DESCRIPTION

1. First Exemplary Embodiment

Hereinafter, a first exemplary embodiment according to the present invention, which is an invention for improving the metallic luster of a toner image formed on a recording medium such as a recording sheet, will be described.

Figure 1:
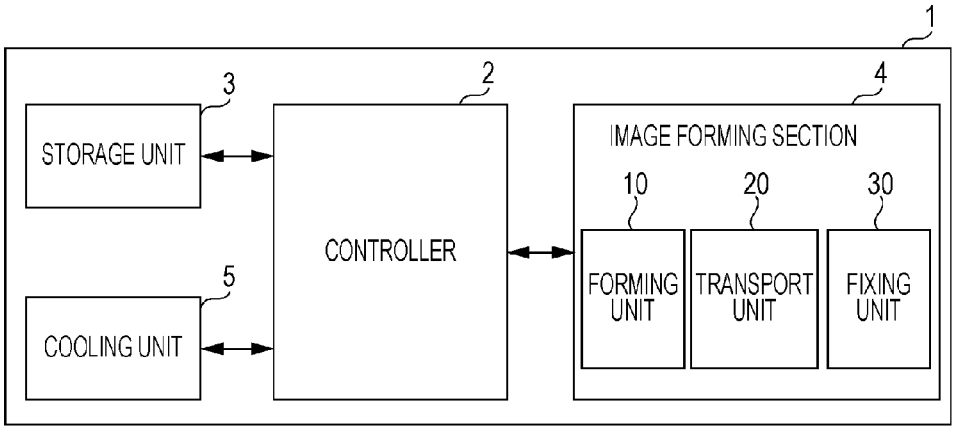
FIG. 1 is a block diagram of an image forming apparatus according to a first exemplary embodiment.

FIG. 1 is a block diagram of an image forming apparatus 1 according to the first exemplary embodiment. The image forming apparatus 1 includes a controller 2, a storage unit 3, an image forming section 4, and a cooling unit 5. The controller 2 includes a central processing unit (CPU), a read only memory (ROM), a random access memory (RAM), and a real-time clock. The controller 2 controls the operations of various devices as the CPU executes programs, which are stored in the ROM or the storage unit, by using the RAM as a work area. The real-time clock calculates the current time and notifies the current time to the CPU.

The controller 2 is connected to an external apparatus through a communication network (not shown). When image data is sent from the external apparatus, the controller 2 controls the image forming section 4 to form an image based on the image data on a recording medium. Thus, the image forming apparatus 1 includes a computer that processes information representing an image or the like by using the CPU. The storage unit 3, which includes a hard disk and the like, stores data and programs with which the CPU controls the image forming apparatus 1.

The image forming section 4 forms a color image on the recording medium by fixing toner images formed by using toners of the following six colors: yellow (Y), magenta (M), cyan (C), black (K), gold (G), and silver (S). The gold (G) toner and the silver (S) toner are metallic toners each including a resin and flat metallic pigment particles. An image having metallic luster is formed when the surfaces of the metallic pigment particles are substantially parallel to the surface of the recording medium.

Figure 2:
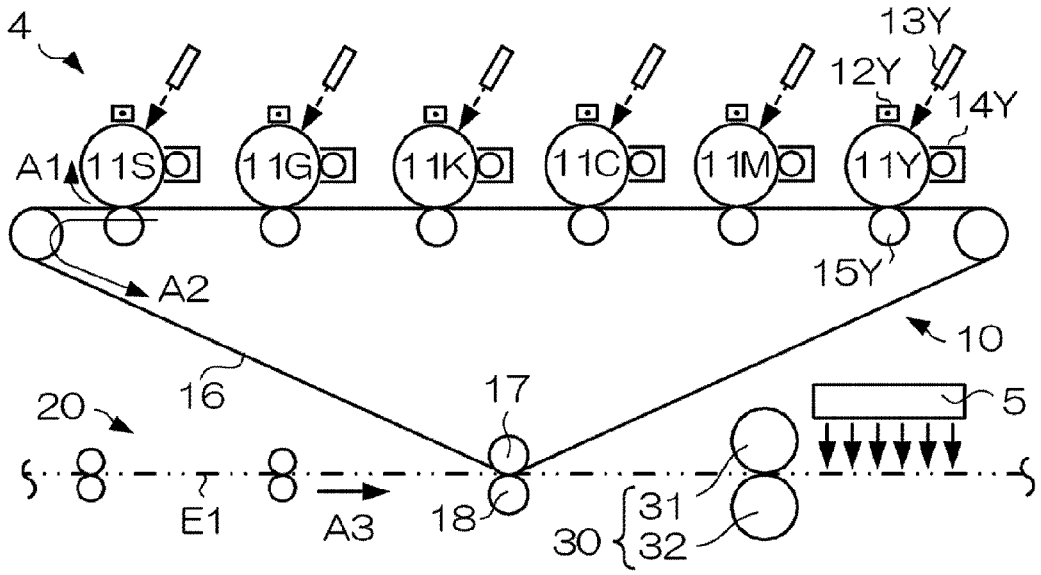
FIG. 2 illustrates the details of the structure of an image forming unit.

The image forming section 4 includes a forming unit 10, a transport unit 20, and a fixing unit 30. The forming unit 10 forms a toner image. To be specific, the forming unit 10 forms toner images on photoconductor drums described below; forms a toner image on an intermediate transfer belt by first-transferring the toner images; and forms a toner image on the recording medium, which is being transported by the transport unit 20, by second-transferring the toner image. The transport unit 20 transports the recording medium. The fixing unit 30 fixes the toner image, which has been formed on the recording medium by the forming unit 10, to the recording medium. Referring to FIG. 2, the details of the image forming section 4 will be described.

FIG. 2 illustrates the details of the structure of the image forming section 4. The forming unit 10 of the image forming section 4 includes photoconductor drums 11, charging units 12, exposure units 13, development units 14, first-transfer rollers 15, an intermediate transfer belt 16, a second-transfer roller 17, and a backup roller 18. The photoconductor drums 11, the charging units 12, the exposure units 13, the development units 14, and the first-transfer rollers 15, which are provided so as to correspond to the colors Y, M, C, K, G, and S, are sequentially arranged along the intermediate transfer belt 16 in the rotation direction A2 indicated by an arrow in FIG. 2.

In FIG. 2, letters (Y, M, C, K, G, and S) representing the colors are attached to the numerals of these units and rollers to indicate the units and rollers that form toner images of the corresponding colors. For convenience of drawing, the numerals of these units and rollers are attached to only the units and rollers for Y, and only the numeral 11 of the photoconductor drum is attached the units and rollers for the other colors. When it is not necessary to differentiate between these colors, the letters attached to the numerals will be omitted.

The photoconductor drum 11, which has a photosensitive layer, carries an electrostatic latent image on the surface of the photosensitive layer while rotating in a drum rotation direction A1 indicated by an arrow in FIG. 2. When the electrostatic latent image is developed by being supplied with a toner, the photoconductor drum 11 carries the developed toner image. The charging unit 12 charges the photosensitive layer of the photoconductor drum 11 so that the surface has a predetermined charge potential. The exposure unit 13 exposes the photosensitive layer with light by irradiating the charged photosensitive layer with light whose intensity and irradiation position are controlled in accordance with the aforementioned image data. Thus, an electrostatic latent image representing an image based on the image data is formed on the photosensitive layer.

The development unit 14 includes a development roller that attracts and transports charged toner. The development unit 14 develops the electrostatic latent image by supplying a toner from the development roller to the photoconductor drum 11 by applying a development bias voltage across the photoconductor drum 11 and the development roller. As a result, a visible toner image, which is made visible by using the toner, is formed in an area in which the electrostatic latent image was formed. The first-transfer roller 15 is disposed so as to face the photoconductor drum 11 with the intermediate transfer belt 16 therebetween. Due to a voltage applied across the first-transfer roller 15 and the photoconductor drum 11, a potential difference is generated between the photoconductor drum 11 and the intermediate transfer belt 16. Therefore, the toner image on the photoconductor drum 11 is transferred to the intermediate transfer belt 16 (so-called first-transfer).

The intermediate transfer belt 16, which is an endless belt, is an image carrier that carries the first-transferred toner image. The intermediate transfer belt 16 is rotatably supported by plural support rollers and rotated in the belt rotation direction A2. Toner images of colors Y, M, C, K, G, and S are successively first-transferred from the photoconductor drums 11 to the intermediate transfer belt 16. The toner images, which have been first-transferred to the intermediate transfer belt 16, are transferred to a recording medium as described below (so-called second-transfer). Thus, the intermediate transfer belt 16 is an example of an image carrier that carries toner images, which are to be transferred to the recording medium.

The second-transfer roller 17 and the backup roller 18 face each other with the intermediate transfer belt 16 therebetween to form a nip. The transport unit 20, which includes plural transport rollers, transports the recording medium in a transport direction A3 along a transport path E1 extending through the nip. A recording medium transported by the transport unit 20 contacts the intermediate transfer belt 16 in the nip. A voltage is applied to the second-transfer roller 17 so that a potential difference is generated between the second-transfer roller 17 and the backup roller 18. Due to the voltage, the toner images carried by the intermediate transfer belt are second-transferred to the recording medium. Thus, the forming unit 10 forms a toner image on the recording medium.

The fixing unit 30 includes fixing rollers 31 and 32. The fixing rollers 31 and 32 face each other with the transport path E1 therebetween to form a nip region. The surface of the fixing roller 31 is heated to a fixing temperature, and the fixing roller 31 heats the toner image formed on the recording medium and transported to the nip region. The fixing rollers 31 and 32 apply a pressure to the toner image in the nip region. Thus, the fixing unit 30 heats and presses the toner image formed on the recording medium by the forming unit 10, and thereby fixes the toner image to the recording medium. The toner image fixed to the recording medium is an image formed on the recording medium by the image forming section 4 (image based on the image data).

The cooling unit 5 is disposed at a position that is directly behind the fixing unit 30 in the transport direction A3 (downstream of the fixing unit 30 in the transport direction A3) and at which the cooling unit 5 faces the toner image fixed to the recording medium that is transported along the transport path E1. The cooling unit 5 cools the toner image, which has been heated and pressed by the fixing unit 30. In the present exemplary embodiment, the cooling unit 5 includes a fan and cools the toner image by blowing air to the toner image by rotating the fan.

Figure 3:
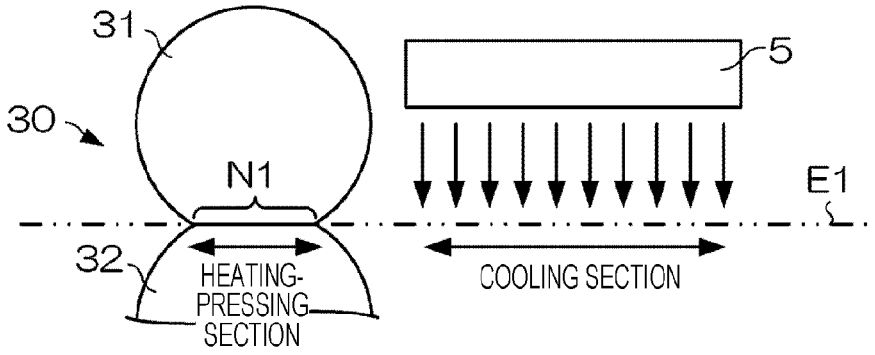
FIG. 3 is an enlarged view of a fixing unit and a cooling unit.
Figure 4A:
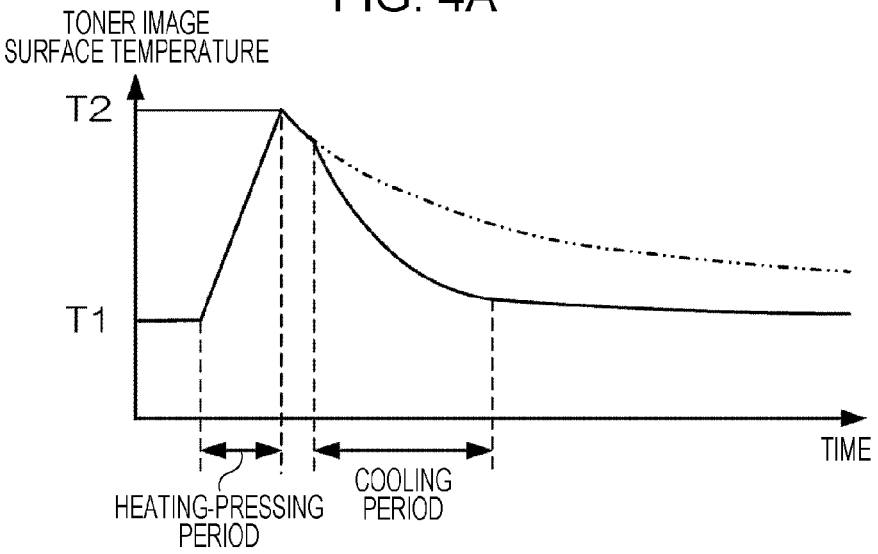
FIGS. 4A and 4B illustrate examples of a state of a toner image in a heating-pressing period and a cooling period.
Figure 4B:
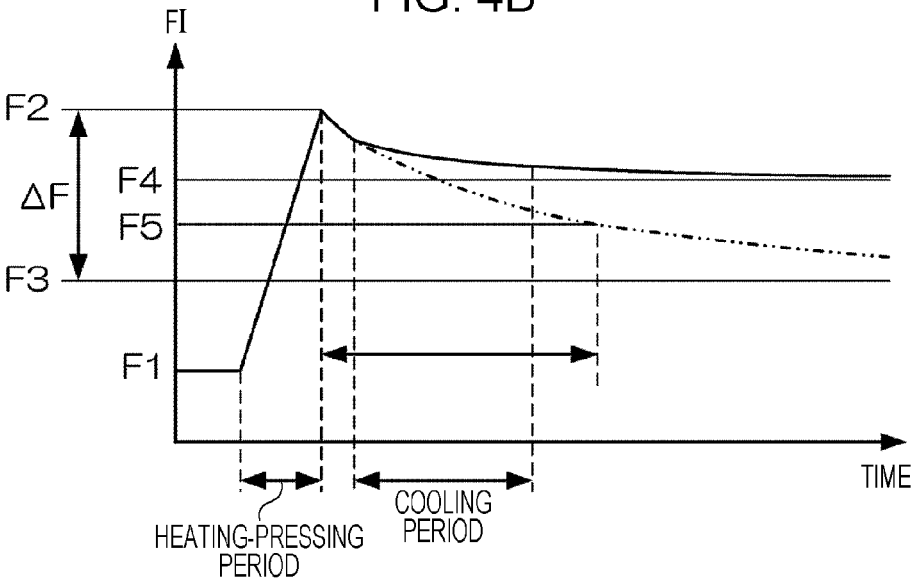

FIG. 3 is an enlarged view of the fixing unit 30 and the cooling unit 5. FIG. 3 illustrates a nip region N1 formed by the fixing rollers 31 and 32. A section of the transport path E1 that overlaps the nip region N1 is a heating-pressing section in which the toner image is heated and pressed. The cooling unit 5 blows air toward the transport path E1 as indicated by arrows. A section of the transport path E1 to which air is blown from the cooling unit 5 is a cooling section in which the toner image is cooled. Referring to FIGS. 4A and 4B, a state of the toner image in a heating-pressing period, which is a period during which the toner image passes through the heating-pressing section, and a cooling period, which is a period during which the toner image passes through the cooling section, will be described.

FIGS. 4A and 4B illustrate examples of a state of the toner image in the heating-pressing period and the cooling period. FIG. 4A is a graph whose vertical axis represents the surface temperature of the toner image and whose horizontal axis represents the time. FIG. 4A represents change in the surface temperature of the toner image with time. The surface temperature of the toner image increases from T1 to T2 in the heating-pressing period and then decreases. If the toner image were not cooled by the cooling unit 5 but cooled only by natural heat dissipation, the surface temperature of the toner image would gradually decrease as shown by a two-dot chain line in FIG. 4A. However, in the image forming apparatus 1, because the cooling unit 5 cools the toner image, the surface temperature of the toner image decreases faster than in the case where the toner image is cooled only by natural heat dissipation.

FIG. 4B is a graph whose vertical axis represents the flop index (FI) of the toner image and whose horizontal axis represents the time. FIG. 4B represents change in the metallic luster of the toner image with time. The FI is measured in accordance with, for example, ASTM E2194 (for example, measured by positioning a light source at an angle of −45 degrees and a light receiver at each of angles of 30 degrees, 0 degrees, and −65 degrees with respect to a line perpendicular to a recording medium). The higher the specular reflectance and lower the diffuse reflectance, the larger the FI. The FI increases from F1 to F2 in the heating-pressing period, and then decreases. Referring to FIGS. 5A to 5C, the reason for this will be described.

FIGS. 5A to 5C illustrate states of metallic pigment particles in a toner image. In FIGS. 5A to 5C, states of a resin C1 and flat metallic pigment particles D1 in a toner image B1 are illustrated. As illustrated in FIG. 5A, before the fixing unit 30 heats and presses the toner image B1, the surface of the resin C1 has undulation and the metallic pigment particles D1 are in a state in which the directions thereof and the distances therebetween are nonuniform. In other words, there are many gaps between the metallic pigment particles D1 and the directions of the surfaces of the metal pigment particles D1 are nonuniform. Therefore, the FI has a small value (F1, in the example shown in FIG. 4). As illustrated in FIG. 5B, when the toner image is heated and pressed in the heating-pressing period, the resin C1 softens and the surface of the resin C1 becomes flat, the distances between the metallic pigment particles D1 become uniform, the gaps between the metallic pigment particles D1 decrease, and the surfaces of the metallic pigment particles D1 become substantially parallel to the surface of the recording medium. In this state, the FI has a large value (F2, in the example shown in FIG. 4).

As the temperature of the toner image decreases after the heating-pressing period, because the resin C1 is viscoelastic, the surface of the resin C1 becomes deformed so as to have undulation again as illustrated in FIG. 5C. Due to the deformation, the directions of the metallic pigment particles D1 in the resin C1 also change, and the FI becomes lower than that of the state illustrated in FIG. 5B. The FI gradually decreases as the deformation of the resin C1 progresses with decreasing temperature and with elapse of time. However, because state of the resin C1 does not return to the state before heating and pressing is performed, the FI converges to a value (F3, in the example shown in FIG. 4) that is larger than the value (F1) at the beginning of the heating-pressing period and smaller than the value (F2) at the end of the heating-pressing period.

Because the resin C1 becomes deformed in a state in which heat used to fix the toner image remains in the resin C1 and the resin C1 is soft, it is possible to reduce the deformation amount by decreasing the temperature of the resin C1 more rapidly. In the image forming apparatus 1, because the cooling unit 5 cools the toner image, the speed with which the FI decreases in the cooling period is lower than that of the case where the toner image is cooled only by natural heat dissipation. As a result, a value F4 to which the FI converges is larger than the value F3 in the case where the toner image is cooled only by natural heat dissipation. Thus, with the present exemplary embodiment, because the cooling unit 5 cools the toner image that has been heated and pressed, as compared with the case where such the cooling is not performed, decrease of metallic luster of the toner image due to the deformation of the resin is suppressed.

As described above, the cooling unit 5 is disposed at a position directly behind the fixing unit 30 in the transport direction A3. To be specific, the cooling unit 5 may be disposed at a position at which cooling is started when the height of the fixed toner image from the recording medium is smaller than the height, from the recording medium, of the toner image cooled by natural heat dissipation. The height of the toner image cooled by natural heat dissipation corresponds to the height of the toner image from the recording medium when the deformation of the resin C1 due to natural heat dissipation settles. By disposing the cooling unit 5 at a position at which cooling is started before the deformation of the resin C1 settles, as compared with a case where the cooling unit 5 is disposed at a position at which cooling is started when the height of the toner image becomes the height, from the recording medium, of the toner image cooled by natural heat dissipation, decrease of the metallic luster of the toner image due to the deformation of the resin C1 is suppressed.

The cooling unit 5 may be disposed at a position at which cooling is started when the temperature of the fixed toner image is higher than or equal to a glass transition temperature. When the temperature of the toner image exceeds the glass transition temperature, the state of the resin C1 changes from a glass-like rigid state to a rubber-like state. Therefore, in the state in which the temperature of the toner image is higher than or equal to the glass transition temperature, the resin C1 becomes more easily deformed and decrease of the metallic luster of the toner image due to the deformation of the resin C1 more easily occurs than in the state in which the temperature of the toner image is lower than the glass transition temperature. Accordingly, by disposing the cooling unit 5 at the aforementioned position, as compared with a case where the cooling unit 5 is disposed at a position at which cooling is started when the temperature of the fixed toner image becomes lower than the glass transition temperature, decrease of the metallic luster of the toner image due to the deformation of the resin C1 is suppressed.

In this case, the cooling unit 5 may cool the toner image until the temperature of the toner image becomes lower than the glass transition temperature. In other words, the cooling unit 5 may cool the toner image so that the temperature of the toner image becomes lower than the glass transition temperature before the toner image passes through the cooling section shown in FIG. 3. For example, the larger the size of the cooling unit 5 in the transport direction A3, the longer the cooling section. In this case, the size of the cooling unit 5 may be determined so that the cooling unit has a sufficient length for making the temperature of the toner image be lower than the glass transition temperature. Thus, as compared with a case where cooling is finished when the temperature of the toner image is still higher than the glass transition temperature, decrease of the metallic luster of the toner image due to the deformation of the resin is suppressed.

Let $\Delta F$ denote the difference between F2, which is the value of the FI at the end of the heating-pressing period, and F3, which is a value to which the FI decreases and converges. In the present exemplary embodiment, the cooling period ends before the FI decreases (to F5 in the example shown in FIG. 4B) by a predetermined proportion R (which is larger than 0 and smaller than 1) of $\Delta F$ if cooling by the cooling unit 5 were not performed. In other words, the cooling unit 5 is disposed so that the cooling period ends before the FI decreases by $\Delta F \times R$. The smaller the proportion R, it is more likely that cooling is performed before the decrease of the FI progresses and that the FI converges to a larger value. Therefore, the proportion R is desirably as small as possible.

However, if the cooling period is too short, the amount of heat dissipated from the toner image due to cooling by the cooling unit is small, and it may occur that the cooling period may end when the temperature of the resin C1 is still high. Accordingly, the proportion R desirably has the smallest value in a range in which it is possible to make the cooling period sufficiently long. In the case where the toner image is cooled during a cooling period that is determined in consideration of these conditions, the cooling unit 5 may be disposed so that the cooling section is located in a range at a distance of 200 mm or larger and 300 mm or smaller from the nip region N1 illustrated in FIG. 3 along the transport path E1.

Method of Measuring Properties

Next, a method for measuring the properties of the toner and other materials used in the first exemplary embodiment will be described.

Method for Measuring Particle Size and Particle Size Distribution of Toner

Measurement of the particle size and particle size distribution of the toner in the present invention is performed by using Coulter Counter Model TA-II (manufactured by Beckman Coulter Inc.) as a measurement device and ISOTON-II (manufactured by Beckman Coulter Inc.) as an electrolyte.

As the method of measurement, 0.5 to 50 mg of sample material is added to a surface-active agent that serves as a dispersant, for example, 2 ml of a 5% aqueous solution of sodium alkylbenzene sulfonate. The resulting liquid is added to 100 to 150 ml of the aforementioned electrolyte. The electrolyte in which the sample is suspended is subjected to a dispersing process performed by an ultrasonic disperser for about one minute, and the particle size distribution of particles having a size in the range of 2 to 60 μm is measured with the aforementioned Coulter Counter Model TA-II by using an aperture having an aperture diameter of 100 μm. Thus, the volume average particle diameter, the GSDv, and the GSDp are obtained. The number of particles in the measured sample material is 50000.

Method for Measuring Molecular Weight and Molecular Weight Distribution of Resin In the present invention, the specific molecular weight distribution is measured under the following conditions. HLC-8120GPC and SC-8020 (manufactured by Tosoh Corporation) are used as gel permeation chromatography (GPC) devices, and two pieces of TSKgel SuperHM-H (6.0 mmID× 15 cm) (manufactured by Tosoh Corporation) are used as columns. Also, tetrahydrofuran (THF) is used as an eluent. With regard to the measurement conditions, the sample concentration is 0.5%, the flow rate is 0.6 ml/min, the amount of sample that is injected is 10 μl, and the measurement temperature is 40° C. An IR detector is used for the detection. A calibration curve is formed by using ten polystyrene standard samples TSK standard, manufactured by Tosoh Corporation: A-500, F-1, F-10, F-80, F-380, A-2500, F-4, F-40, F-128, and F-700.

Volume Average Particle Diameters of Particles Such as Resin Fine Particles and Colorant Particles The volume average particle diameters of particles, such as resin fine particles and colorant particles, are measured by using a laser diffraction particle size distribution analyzer (LA-700 manufactured by Horiba, Ltd.). Method for Measuring Melting Points, Glass Transition Temperatures, and Heat Absorbing Amounts of Resin and Toner The melting points of resin and toner and the glass transition temperatures of toner and resin are measured in accordance with ASTM D3418-8.

Preparation of Resin Fine Particle Dispersion Liquid (1)

Bisphenol-A ethylene oxide two-molar adduct 25 parts by weight

Bisphenol-A propylene oxide two-molar adduct 25 parts by weight

Terephthalic acid 30 parts by weight

Succinic acid 5 parts by weight

Trimellitic anhydride 15 parts by weight

The above-listed materials are introduced into a round bottom flask that is provided with a stirring device, a nitrogen introducing pipe, a temperature sensor, and a rectifying column, and are heated to 200° C. by using a mantle heater. Next, nitrogen gas is introduced through the gas introducing pipe, and the materials are stirred while an inert gas atmosphere is maintained in the flask. Subsequently, 0.05 parts by weight of dibutyltin oxide is added per 100 parts by weight of the material mixture, and caused to react with the mixture for 4 hours while the temperature of the reactant is maintained at 200° C. Thus, a resin (1) is obtained. In this case, several developers are obtained by appropriately changing the temperature of the reactant and the reaction time.

Next, the obtained resin (1) is transferred to an emulsifier (Cavitron CD1010, Eurotec Ltd.) at a rate of 100 g per minute while being maintained in the molten state. A dilute aqueous ammonia solution with a concentration of 0.40%, which is obtained by diluting sample aqueous ammonia with ion-exchanged water, is introduced into an aqueous medium tank that is separately prepared. At the same time as when the polyester resin in the molten state is transferred to the emulsifier, the dilute aqueous ammonia solution is also transferred to the emulsifier at a rate of 0.1 liter per minute while being heated to 120° C. by a heat exchanger. In this state, the emulsifier is operated while the rotational speed of the rotor is set to 60 Hz and the pressure is set to 0.49 MPa (5 kg/cm$^2$). As a result, resin fine particle dispersion liquid (1) is obtained.

Preparation of Release Agent Dispersion Liquid Release Agent Dispersion Liquid (1)

Polyethylene wax (Polywax 725 manufactured by Toyo Petrolite Co., Ltd., melting temperature 102° C.) 50 parts by weight Anionic surface-active agent (Neogen RK manufactured by DKS Co. Ltd.) 5 parts by weight Ion-exchanged water 200 parts by weight The above-listed materials are mixed, heated to 110° C. so that they are dissolved, and dispersed by using a homogenizer (Ultra-Turrax T50 manufactured by IKA Works, Inc.). Then, a dispersing process is performed by a Manton-Gaulin high-pressure homogenizer (manufactured by Gaulin Corporation), so that a release agent dispersion liquid (1), in which a release agent having a volume average particle diameter of 220 nm is dispersed (the release agent concentration: 20%), is prepared.

Preparation of Colorant Dispersed Liquid (1)

Alumina pigment

Anionic surface-active agent

Ion-exchanged water

The above-listed materials are mixed, dissolved, and dispersed for about one hour by using a high-pressure impact disperser Ultimizer (HJP30006 manufactured by Sugino Machine Ltd.). Thus, a colorant dispersion liquid (1), in which a colorant (alumina pigment) is dispersed, is prepared. In the present exemplary embodiment, several developers are obtained by appropriately changing the particle diameters of colorant (alumina pigment) in the colorant dispersion liquid (1).

Production of Toner Particles

Resin fine particle dispersion liquid 400 parts by weight

Release agent dispersion liquid 50 parts by weight

Colorant dispersion liquid (1) 22 parts by weight

The above-listed materials are introduced into a round stainless steel flask. Next, 1.5 parts by weight of a 10% aqueous solution of polyaluminum chloride (manufactured by Asada Chemical INDUSTRY Co., Ltd.) is added, and pH of the system is adjusted to 2.5 by using a 0.1 N aqueous solution of nitric acid. Subsequently, stirring is performed at room temperature for 30 minutes. Then, mixing dispersion is performed by using a homogenizer (Ultra-Turrax T50 manufactured by IKA Works, Inc.), and the temperature is increased to 45° C. and maintained at 45° C. for 30 minutes while stirring is performed in a heating oil bath. Then, 50 parts by weight of resin dispersion liquid is added, and the temperature is increased to 50° C. and maintained at 50° C. for an hour.

When the resulting material is observed with an optical microscope, it is confirmed that agglomerated particles having a particle diameter of about 7.5 μm are generated. The pH is adjusted to 7.5 by using an aqueous solution of sodium hydroxide. Subsequently, the temperature is increased to 80° C. and maintained at 80° C. for 2 hours in a heating oil bath. Then, the resulting material is cooled to room temperature, filtered, sufficiently cleaned with ion-exchanged water, and dried by using a vacuum dryer. Thus, toner particles 1 are obtained. One part by weight of colloidal silica (R972 manufactured by Japan Aerosil Co., Ltd.) is added per 100 parts by weight of the obtained toner particles, and additive mixing is performed with a Henschel mixer. Thus, electrostatic charge image development toner (hereinafter may be referred to simply as toner) is obtained.

Production of Electrostatic Charge Image Developer

A carbon dispersion liquid is obtained by mixing 1.25 parts by weight of toluene and 0.12 parts by weight of carbon black (trade name VXC-72, manufactured by Cabot Corporation) and subjecting the mixture to stirring dispersion performed by a sand mill for 20 minutes. Then, the obtained carbon dispersion liquid and 1.25 parts by weight of a 80% ethyl acetate solution of trifunctional isocyanate (Takenate D110N manufactured by Takeda Pharmaceutical Co., Ltd.) are mixed and stirred, so that a coating agent resin solution is obtained. Then, the obtained coating agent resin solution and Mn—Mg—Sr ferrite particles (volume average particle diameter: 35 rim) are supplied to a kneader, and are mixed and stirred at normal temperature for 5 minutes. Then, the temperature is increased to 150° C. at normal pressure so that the solvent is removed. Then, mixing and stirring are performed for 30 minutes, and the power of the heater is turned off until the temperature is reduced to 50° C. The obtained coat carrier is sieved with a mesh of 75 μm. Thus, carrier is made. Electrostatic charge image developer is obtained by mixing, with a V blender, 95 parts by weight of the obtained carrier and 5 parts by weight of the electrostatic charge image developing toner obtained by the aforementioned method.

Regarding the image forming apparatus according to the present exemplary embodiment, the FI is measured by using toners including alumina pigments whose particle diameters vary. A good result is obtained when a toner including an alumina pigment whose particle diameter is in the range of 4 to 12 μm is used.

2. Second Exemplary Embodiment

A second exemplary embodiment of the present invention will be described with an emphasis on the difference from the first exemplary embodiment. In the first exemplary embodiment, the cooling strength with which the cooling unit 5 cools the toner image is not changed. In the second exemplary embodiment, this is changed.

The cooling unit 5 according to the present exemplary embodiment is capable of changing the rotation speed of the fan in accordance with control by the controller 2. The controller 2 controls the cooling unit 5 to change the cooling strength with which the cooling unit 5 cools the toner image in accordance with a predetermined condition. In the present exemplary embodiment, the transport speed of the recording medium is used as the predetermined condition. To be specific, the controller 2 causes the cooling unit 5 to cool the recording medium more strongly as the transport speed of the recording medium increases. The controller 2 performs this control by using, for example, a control table.

FIG. 6 illustrates an example of the control table. In the example shown in FIG. 6, the ranges of the transport speed "lower than G1", "G1 or higher and lower than G2", and "G2 or higher" correspond to the cooling strengths "low", "intermediate", and "high". The controller 2 calculates the transport speed of a recording medium that passes through the nip region N1 from, for example, the rotation speeds of the fixing rollers 31 and 32. Then, the controller 2 controls the cooling unit 5 so that the cooling unit 5 cools the recording medium with a cooling strength corresponding to the range in which the calculated transport speed is included. In the present exemplary embodiment, the cooling strength is controlled by changing the rotation speed (revolutions per minute (rpm)) of the fan. The controller 2 causes the cooling unit 5 to increase the rotation speed of the fan when increasing the cooling strength and causes the cooling unit 5 to decrease the rotation speed of the fan when decreasing the cooling strength.

For example, as the transport speed increases, the time required by the recording medium to pass through the cooling section decreases, and therefore the cooling period becomes shorter. Therefore, if the cooling strength is not changed, the temperature of the resin included in the toner image does not become lower than that before the transport speed changes, and thereby the deformation of the resin progresses and the metallic luster decreases. In the present exemplary embodiment, as the transport speed increases, the toner image is cooled more strongly in accordance with the increase of the transport speed. Therefore, even though the cooling period becomes shorter, the temperature of the resin is reduced. Thus, as compared with the case where the cooling strength of cooling the toner image is not changed, change in the metallic luster due to a change in a condition (in the present exemplary embodiment, the transport speed) is suppressed.

3. Modifications

The exemplary embodiments described above, each of which is an example for carrying out the present invention, may be modified as described below. The exemplary embodiments described above and the modifications described below may be used in combination as necessary.

3-1. Cooling Unit

The cooling unit may cool a toner image by using a method different from those of the exemplary embodiments.

Figures 7, 8, 9, 10:
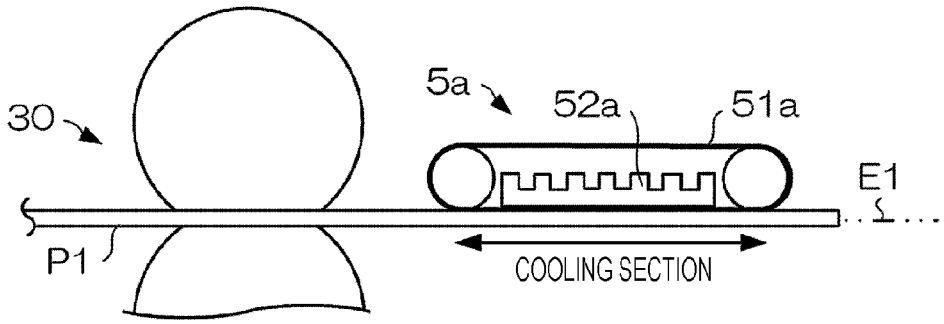
FIG. 7 illustrates a cooling unit according to a modification.
FIG. 8 illustrates an example of a control table according to a modification.
FIG. 9 illustrates an example of a control table according to a modification.
FIG. 10 illustrates an example of a control table according to a modification.

FIG. 7 illustrates a cooling unit 5*a* according to the present modification. The cooling unit 5*a* includes a belt 51*a* and a heat sink 52*a*. The belt 51*a* is an endless belt that is rotated by a roller. The outer peripheral surface of the belt 51*a* contacts a recording medium P1 along the whole length of a cooling section and contacts a toner image formed on the recording medium P1.

An outer peripheral surface of the belt 51*a* contacts the recording medium P1 and the toner image. The heat sink 52*a* contacts an inner peripheral surface of the belt 51*a*, which is opposite to the outer peripheral surface, and cools the toner image through the belt 51*a*. In this way, the cooling unit may cool a toner image by contacting the toner image, that is, by using a contact method. Alternatively, the cooling unit may cool a toner image by using a non-contact method as in the exemplary embodiments. Further alternatively, in addition to the cooling unit disposed on the toner image side of the recording medium, another cooling unit may be disposed on the opposite side of the recording medium to indirectly cool the toner image.

3-2. Control of Cooling Strength

In the second exemplary embodiment, the controller 2 changes the cooling strength by changing the rotation speed of the fan of the cooling unit 5. However, this is not a limitation. Alternatively, for example, the cooling strength may be changed by changing the time for which the fan is rotated, that is, the length of the cooling period. Further alternatively, in the aforementioned modification in which cooling is performed by using a contact method, the cooling strength may be changed by changing the temperature of a member of the cooling unit that contacts the recording medium.

3-3. Image Forming Apparatus

In the exemplary embodiments described above, the image forming apparatus forms a color image by using plural photoconductor drums and plural development units that are arranged along the intermediate transfer belt. However, this is not a limitation. Alternatively, for example, the image forming apparatus may include a so-called rotary development unit in which development units are arranged in the circumferential direction of a rotational member. Further alternatively, the image forming apparatus may be a so-called direct transfer apparatus that directly transfers images from photoconductor drums to a recording medium. The arrangement of photoconductor drums in the image forming apparatus is not limited to that shown in FIG. 2. Alternatively, for example, photoconductor drums for metallic toners may be disposed not downstream, but upstream of photoconductor drums for other colors in the belt rotation direction A2. Further alternatively, photoconductor drums for metallic toners may be disposed between photoconductor drums for other colors.

3-4. Fixing Unit

In the exemplary embodiments, in the fixing unit 30, only the fixing roller 31 is heated. Alternatively, both of the fixing rollers 31 and 32 may be heated. In this case, the fixing temperatures of these rollers may differ from each other. Further alternatively, a toner image may be fixed by using a fixing belt instead of the fixing roller.

3-5. Control Based on Heat Amount

The controller 2 may change the cooling strength on the basis of the amount of heat that the fixing unit 30 applies to a toner image. To be specific, the controller 2 causes the cooling unit 5 to more strongly cool the toner image as the amount of heat that the fixing unit 30 applies to the toner image increases. For example, in the case where the fixing roller 31 is heated to the fixing temperature and the fixing roller 31 heats the toner image as in the exemplary embodiments, the controller 2 uses the level of the fixing temperature to control the amount of heat to be applied to the toner image.

FIG. 8 illustrates an example of a control table according to the present modification. In the example shown in FIG. 8, the ranges of the fixing temperature "lower than H1", "H1 or higher and lower than H2", and "H2 or higher" correspond to the cooling strengths "low", "intermediate", and "high". The controller 2 calculates the fixing temperature from, for example, the intensity of heating of the fixing roller 31. Then, the controller 2 controls the cooling unit 5 so that the cooling unit 5 cools the recording medium with a cooling strength corresponding to the range in which the calculated fixing temperature is included.

As the amount of heat that the fixing unit 30 applies to the toner image increases, the temperature of the resin at the end of the heating-pressing period increases. Therefore, if the cooling strength is not changed, the temperature of the resin included in the toner image at the end of the cooling period becomes higher than that before the fixing temperature is changed, and, thereafter the deformation of the resin progresses and the metallic luster decreases. However, in the present modification, when the amount of heat applied to the toner image increases, the toner image is cooled more strongly in accordance with the increase of the amount of heat. Therefore, even if the temperature of the resin at the end of the heating-pressing period increases, the decrease of the temperature of the resin during the cooling period also increases. Thus, as compared with a case where the cooling strength of cooling the toner image is not changed, change in the metallic luster due to a change in a condition (in the present modification, the amount of heat applied to the toner image) is suppressed.

3-6. Control Based on Heat Capacity of Recording Medium

The controller 2 may change the cooling strength on the basis of the type of a recording medium. For example, the controller 2 cools the recording medium more strongly as the heat capacity of the recording medium decreases.

FIG. 9 illustrates an example of a control table according to the present modification. In the example shown in FIG. 9, the types of the recording medium "normal sheet" and "thick sheet" correspond to the cooling strengths "high" and "low". For example, the controller 2 detects the thickness of the recording medium by using a sensor disposed in the transport path E1, and determines whether the recording medium is a normal sheet or a thick sheet on the basis of the detected thickness.

The controller 2 controls the cooling unit 5 so that the cooling unit 5 cools the recording medium with a cooling strength corresponding to the determined type of the recording medium. The type of the recording medium is not limited to a normal sheet and a thick sheet. Alternatively, the recording medium may be an envelope, a post card, or an OHP sheet. Further alternatively, if it is possible to measure the thickness of the recording medium, the recording medium may be classified according to the measured thickness. In any of these cases, the controller 2 may control the cooling strength in accordance with the heat capacity of the recording medium.

As the heat capacity of a recording medium increases, it becomes more difficult to increase the temperature of the recording medium sufficiently in the heating-pressing period. As a result, the difference between the temperature of the toner image and the temperature of the recording medium becomes larger, and the heat of the resin becomes more likely to be dissipated to the recording medium after the heating-pressing period has ended. In contrast, as the heat capacity of the recording medium decreases, the heat of the resin becomes more unlikely to be dissipated to the recording medium. Therefore, for example, in a case where a normal sheet is used, as compared a case where a thick sheet is used, the temperature of the resin does not easily decrease after the heating-pressing period has ended. If the cooling strength and the metallic luster at the end of the heating-pressing period were the same as those of the case where a thick sheet is used, in the case where a normal sheet is used, the deformation of the resin would progress further than in the case where a thick sheet is used and the metallic luster would decrease.

In the present modification, even if the heat capacity of the recording medium is low and the temperature of the resin does not easily decrease, the toner image is cooled more strongly in accordance with the low heat capacity of the recording medium, and thereby the decrease of temperature of the resin during the cooling period is increased. Thus, as compared with the case where the cooling strength of cooling the toner image is not changed, change in the metallic luster due to a change in a condition (in the present modification, the heat capacity of the recording medium) is suppressed.

In the case where a thick sheet is used as the recording medium, because the heat of the resin is easily dissipated to the recording medium, the metallic luster at the end of the heating-pressing period may be lower than that of the case where a normal sheet is used. In this case, by increasing the cooling strength of cooling the thick sheet and decreasing the cooling strength of cooling the normal sheet, change in the metallic luster due to a change in the type of the recording medium is suppressed. In this way, the controller 2 may change the cooling strength of cooling the toner image in accordance with the type of the recording medium.

3-7. Control Based on Pressure

The controller 2 may change the cooling strength on the basis of a pressure that the fixing unit 30 applies to a toner image. In the present modification, the distance between the fixing rollers 31 and 32 is adjustable. The controller 2 calculates a pressure applied to the toner image in accordance with this distance. For example, the controller 2 causes the cooling unit 5 to more strongly cool the toner image as a pressure that the fixing unit 30 applies to the toner image increases.

FIG. 10 illustrates an example of a control table according to the present modification. In the example shown in FIG. 10, the ranges of the pressure "lower than J1", "J1 or higher and lower than J2", and "J2 or higher" correspond to the cooling strengths "high", "intermediate", and "low". The controller 2 calculates the pressure applied to the toner image as described above. Then, the controller 2 controls the cooling unit 5 so that the cooling unit 5 cools the recording medium with a cooling strength corresponding to the range in which the calculated pressure is included.

As the pressure that the fixing unit 30 applies to the toner image increases, the amount of deformation of the resin in the heating-pressing period increases, and the state of the toner image becomes closer to that shown in FIG. 5B. In contrast, as the pressure decreases, the state of the toner image does not become close to that shown in FIG. 5B, and the metallic luster decreases. Therefore, if the speed of the deformation of the resin after heating depends on the temperature of the resin and the cooling strength is not changed, in a case where the pressure applied to the toner image is low, as compared with a case where the pressure is high, the metallic luster of the toner image at the end of the cooling period is lower and the value to which the metallic luster converges is also smaller. However, in the present modification, in the case where the pressure applied to the toner image is low, the toner image is more strongly cooled than in the case where the pressure is high. By doing so, the decrease of the metallic luster is reduced. Thus, as compared with a case where the cooling strength of cooling the toner image is not changed, change in the metallic luster due to a change in a condition (in the present modification, the pressure applied to the toner image) is suppressed.

3-8. Control Based on Nip Width

The controller 2 may change the cooling strength on the basis of a nip width (the width of the nip region N1 in the transport direction A3). In the present modification, the distance between the rotary shafts of the fixing rollers 31 and 32 is adjustable. The controller 2 calculates the nip width in accordance with the distance. For example, the controller 2 causes the cooling unit 5 to more strongly cool the toner image as the nip width increases.

Figures 11, 12, 13:
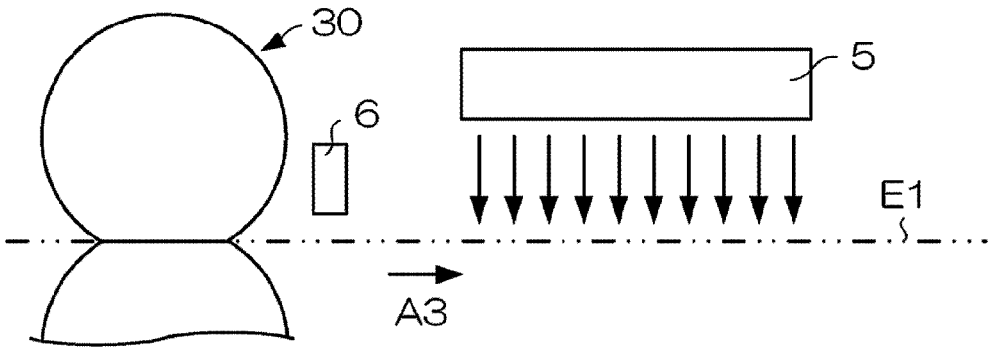
FIG. 11 illustrates an example of a control table according to a modification.
FIG. 12 illustrates an example of a control table according to a modification.
FIG. 13 illustrates a fixing unit and a cooling unit according to a modification.

FIG. 11 illustrates an example of a control table according to the present modification. In the example shown in FIG. 11, the ranges of the nip width "smaller than K1", "K1 or larger and smaller than K2", and "K2 or larger" correspond to the cooling strengths "low", "intermediate", and "high". The controller 2 calculates the nip width as described above. Then, the controller 2 controls the cooling unit 5 so that the cooling unit 5 cools the recording medium with a cooling strength corresponding to the range in which the calculated nip width is included.

As the nip width increases, the heating-pressing period becomes longer and the amount of deformation of the resin in the heating-pressing period increases, and the state of the toner image becomes closer to that shown in FIG. 5B. In contrast, as the nip width decreases, the state of the toner image does not become close to that shown in FIG. 5B, and the metallic luster becomes low. Therefore, if the speed of the deformation of the resin after heating depends on the temperature of the resin and the cooling strength is not changed, in a case where the nip width is small, as compared with a case where the nip width is large, the metallic luster of the toner image at the end of the cooling period is lower, and the value to which the metallic luster converges is also smaller. In the present modification, in the case where the nip width is small, the toner image is more strongly cooled than in the case where the nip width is large. By doing so, the decrease of the metallic luster is reduced. Thus, as compared with a case where the cooling strength of cooling the toner image is not changed, change in the metallic luster due to a change in a condition (in the present modification, the nip width) is suppressed.

3-9. Control Based on Toner Amount

The controller 2 may change the cooling strength on the basis of the toner amount in the toner image. For example, on the basis of the size, the shape, or the color of an image to be formed, the controller 2 calculates the toner amount in the toner image for representing the image. The toner amount may be the amount of toner per unit area or the total amount of toner in the toner image. The controller 2 causes the cooling unit 5 to more strongly cool the toner image as the toner amount in the toner image increases.

FIG. 12 illustrates an example of a control table according to the present modification. In the example shown in FIG. 12, the ranges of the toner amount "smaller than L1", "L1 or larger and smaller than L2", and "L2 or larger" correspond to the cooling strengths "low", "intermediate", and "high". The controller 2 controls the cooling unit 5 so that the cooling unit 5 cools the recording medium with a cooling strength corresponding to the range in which the calculated toner amount is included. As the toner amount decreases, the temperature of the resin included in the toner image increases in the heating-pressing period, and the state of the toner image becomes closer to that shown in FIG. 5B. In contrast, as the toner amount decreases, the state of the toner image does not become close to that shown in FIG. 5B, and the metallic luster becomes low.

Therefore, if the speed of deformation of the resin after heating depends on the temperature of the resin and the cooling strength is not changed, in a case where the toner amount is large, as compared with a case where the toner amount is small, the metallic luster of the toner image at the end of the cooling period is lower, and the value to which the metallic luster converges is also smaller. In the present modification, in the case where the toner amount is large, the toner image is more strongly cooled than in the case where the toner amount is small. By doing so, the decrease of the metallic luster is reduced. Thus, as compared with a case where the cooling strength of cooling the toner image is not changed, change in the metallic luster due to a change in a condition (in the present modification, the toner amount) is suppressed.

3-10. Control Based on Temperature of Toner Image

The controller 2 may change the cooling strength on the basis of the temperature of a toner image. The temperature of the toner image is actually measured.

FIG. 13 illustrates a fixing unit 30 and a cooling unit 5 according to the present modification. A first measurement unit 6 is disposed at a position that is downstream of the fixing unit 30 in the transport direction A3 and upstream of the cooling unit 5 in the transport direction A3. The first measurement unit 6 is a non-contact temperature sensor that is disposed so as to face a toner image fixed to the recording medium. The first measurement unit 6 measures the temperature of the toner image that the fixing unit has finished heating. The controller 2 causes the cooling unit 5 to more strongly cool the toner image as the temperature measured by the first measurement unit 6 increases.

Figures 14, 15, 16A, 16B:
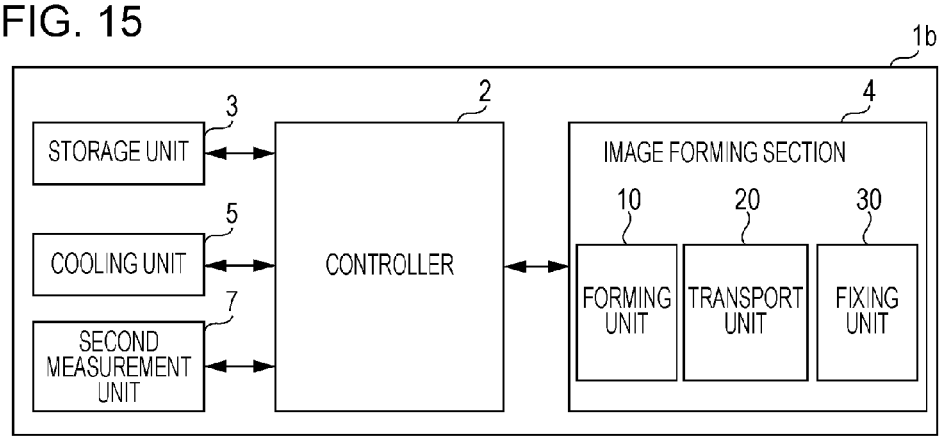
FIG. 14 illustrates an example of a control table according to a modification.
FIG. 15 is a block diagram of an image forming apparatus according to a modification.
FIGS. 16A and 16B illustrate examples of control tables according to a modification.

FIG. 14 illustrates an example of a control table according to the present modification. In the example shown in FIG. 14, the ranges of the temperature of the toner image "lower than M1", "M1 or higher and lower than M2", and "M2 or higher" correspond to the cooling strengths "low", "intermediate", and "high". The controller 2 controls the cooling unit 5 so that the cooling unit 5 cools the recording medium with a cooling strength corresponding to the range in which the measured temperature of the toner image is included. As the measured temperature of the toner image increases, the temperature of the resin included in the toner image increases in the heating-pressing period, and the state of the toner image becomes closer to that shown in FIG. 5B. In contrast, as the temperature of the toner image decreases, the state of the toner image does not become close to that shown in FIG. 5B, and the metallic luster becomes low.

Therefore, if the speed of deformation of the resin after heating depends on the temperature of the resin and the cooling strength is not changed, in a case where the temperature of the toner image is low, as compared with a case where the temperature of the toner image is high, the metallic luster of the toner image at the end of the cooling period is lower, and the value to which the metallic luster converges is also smaller. In the present modification, in the case where the measured temperature of the fixed toner image is low, the toner image is more strongly cooled than in the case where the temperature is high. By doing so, the decrease of the metallic luster is reduced. Thus, as compared with a case where the cooling strength of cooling the toner image is not changed, change in the metallic luster due to a change in a condition (in the present modification, a difference in the temperature of the fixed toner image) is suppressed.

3-11. Control Based on Temperature or Humidity

The controller 2 may change the cooling strength on the basis of ambient temperature or humidity.

FIG. 15 is a block diagram of an image forming apparatus 1*b* according to the present modification. The image forming apparatus 1*b* further includes a second measurement unit 7 in addition to the units shown in FIG. 1. The second measurement unit 7 is a thermohygrometer that measures ambient temperature or humidity. The second measurement unit is disposed, for example, in the housing of the image forming apparatus 1*b*, and measures the temperature and humidity of air in the housing. The controller 2 cools the toner image with a cooling strength corresponding to the ambient temperature or humidity measured by the second measurement unit.

FIGS. 16A and 16B illustrate examples of control tables according to the present modification. In FIG. 16A, the ranges of ambient temperature "lower than N1", "N1 or higher and lower than N2", and "N2 or higher" correspond to the cooling strengths "high", "intermediate", and "low". The controller 2 controls the cooling unit 5 so that the cooling unit 5 cools the recording medium with a cooling strength corresponding to the range in which the measured ambient temperature is included. As the measured ambient temperature increases, the temperature of the resin included in the toner image increases in the heating-pressing period, and the state of the toner image easily becomes closer to that shown in FIG. 5B. In contrast, as the ambient temperature decreases, the state of the toner image does not become close to that shown in FIG. 5B, and the metallic luster tends to become low.

Therefore, as ambient temperature decreases, the metallic luster of the toner image at the end of the cooling period decreases, and the value to which the metallic luster converges decreases. In the present modification, in a case where ambient temperature is low, the toner image is more strongly cooled than in a case where ambient temperature is high. By doing so, the decrease of the metallic luster is reduced. Thus, as compared with a case where the cooling strength of cooling the toner image is not changed, change in the metallic luster due to a change in a condition (in the present modification, ambient temperature) is suppressed.

In FIG. 16B, the ranges of humidity "lower than P1", "P1 or higher and lower than P2", and "P2 or higher" correspond to the cooling strengths "low", "intermediate", and "high". The controller 2 controls the cooling unit 5 so that the cooling unit 5 cools the recording medium with a cooling strength corresponding to the range in which the measured humidity is included. As the measured humidity increases, the moisture content of the recording medium increases, a larger amount of heat applied to the recording medium by the fixing unit 30 is used to evaporate water, and the temperature of the resin at the end of the heating-pressing period decreases.

Therefore, as humidity increases, the metallic luster of the toner image at the end of the cooling period decreases, and the value to which the metallic luster converges decreases. In the present modification, in a case where humidity is high, the toner image is more strongly cooled than in a case where humidity is low. By doing so, the decrease of the metallic luster is reduced. Thus, as compared with a case where the cooling strength of cooling the toner image is not changed, change in the metallic luster due to a change in a condition (in the present modification, humidity) is suppressed.

3-12. Table

The tables shown in FIG. 6 and other figures are examples, and other tables may be used. For example, in the control table shown as an example in FIG. 6, the transport speed is divided into three ranges. Alternatively, the transport speed may be divided into two ranges or four or more ranges. Further alternatively, in these operations, instead of tables, values obtained by using mathematical expressions and conditional expressions may be used. For example, regarding the example shown in FIG. 6, the cooling strength may be changed by using a mathematical expression that converts the transport speed into the cooling strength (such as the number of rotation of the fan). In other words, in these operations, a parameter may be determined in accordance with another parameter (in the example shown in FIG. 6, the cooling strength is determined in accordance with the transport speed).

3-13. Category of Invention

The present invention may be carried out as a method or a process with which the image forming apparatus changes the cooling strength of the cooling unit or may be carried out as a program for causing a computer for controlling the image forming apparatus to execute the process. This program may be provided in any manners. For example, the program may be stored in a recording medium, such as an optical disc; or may be downloaded through a communication network and installed in the computer to be executed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit configured to transport a recording medium;

a forming unit configured to form a toner image on the recording medium, the toner image including a resin and a flat metallic pigment;

a fixing unit configured to fix the toner image to the recording medium by heating and pressing the toner image; and a cooling unit configured to cool the toner image fixed by the fixing unit, the cooling unit being disposed at a position at which the cooling is started when a temperature of the toner image is higher than or equal to a glass transition temperature.

2. An image forming apparatus comprising:

a transport unit configured to transport a recording medium;

a forming unit configured to form a toner image on the recording medium, the toner image including a resin and a flat metallic pigment;

a fixing unit configured to fix the toner image to the recording medium by heating and pressing the toner image; and a cooling unit configured to cool the toner image fixed by the fixing unit, the cooling unit being disposed at a position at which the cooling is started when a height of the toner image from the recording medium is smaller than a height, from the recording medium, of the toner image cooled by natural heat dissipation.

3. The image forming apparatus according to claim 1, wherein the cooling unit is configured to cool the toner image until the temperature of the toner image becomes lower than the glass transition temperature.

4. The image forming apparatus according to claim 1, further comprising:

a controller configured to cause the cooling unit to more strongly cool the toner image as a transport speed of the recording medium increases.

5. The image forming apparatus according to claim 1, further comprising:

a controller configured to cause the cooling unit to more strongly cool the toner image as an amount of heat that the fixing unit applies to the toner image increases.

6. The image forming apparatus according to claim 1, further comprising:

a controller configured to cause the cooling unit to change a cooling strength with which the cooling unit cools the toner image in accordance with a thickness of the recording medium.

7. The image forming apparatus according to claim 1, further comprising:

a controller configured to cause the cooling unit to more strongly cool the toner image as a pressure that the fixing unit applies to the toner image increases.

8. The image forming apparatus according to claim 1, wherein the fixing unit is configured to form a nip region and to heat and press the toner image in the nip region, and wherein the image forming apparatus further comprises a controller configured to cause the cooling unit to more strongly cool the toner image as a width of the nip region in a transport direction increases.

9. The image forming apparatus according to claim 1, further comprising:

a controller configured to cause the cooling unit to more strongly cool the toner image as a toner amount in the toner image increases.

10. The image forming apparatus according to claim 1, further comprising:

a first measurement unit that measures the temperature of the toner image that the fixing unit has finished heating; and a controller configured to cause the cooling unit to more strongly cool the toner image as the measured temperature increases.

11. The image forming apparatus according to claim 1, further comprising:

a second measurement unit configured to measure ambient temperature or humidity; and a controller configured to cause the cooling unit to cool the toner image with a cooling strength corresponding to the measured ambient temperature or humidity.

12. An image forming method comprising:

transporting a recording medium;

forming a toner image on the recording medium, the toner image including a resin and a flat metallic pigment;

fixing the toner image to the recording medium by heating and pressing the toner image; and cooling the fixed toner image, the cooling being started when a temperature of the toner image is higher than or equal to a glass transition temperature.

13. The image forming apparatus according to claim 1, wherein the flat metallic pigment has a substantially flat surface.

14. The image forming apparatus according to claim 1, wherein the cooling unit is configured to cool the toner image fixed by the fixing unit, after the toner image has been fixed by the fixing unit.

15. The image forming apparatus according to claim 1, wherein the cooling unit is separate from the fixing unit.

* * * * *